US008561548B2

(12) United States Patent
Liu et al.

(10) Patent No.: US 8,561,548 B2
(45) Date of Patent: Oct. 22, 2013

(54) JOURNAL BOX RUBBER PAD AND BOGIE

(75) Inventors: Zhenming Liu, Heilongjiang (CN); Lidong Li, Heilongjiang (CN); Shuming Xing, Heilongjiang (CN); Haibin Hu, Heilongjiang (CN); Weichun Ren, Heilongjiang (CN); Chaoyu Li, Heilongjiang (CN); Pingwei Yin, Heilongjiang (CN)

(73) Assignee: Qiqihar Railway Rolling Stock Co., Ltd., Heilongjiang (CN)

( * ) Notice: Subject to any disclaimer, the term of this patent is extended or adjusted under 35 U.S.C. 154(b) by 179 days.

(21) Appl. No.: 13/177,813

(22) Filed: Jul. 7, 2011

(65) Prior Publication Data

US 2013/0008338 A1 Jan. 10, 2013

(51) Int. Cl.
*B61F 5/26* (2006.01)

(52) U.S. Cl.
USPC ..... 105/218.1

(58) Field of Classification Search
USPC ..... 105/157.1, 218.1–221.1
See application file for complete search history.

(56) References Cited

U.S. PATENT DOCUMENTS 5,450,799 A * 9/1995 Goding ..... 105/222

* cited by examiner

*Primary Examiner* — R. J. McCarry, Jr.
(74) *Attorney, Agent, or Firm* — J.C. Patents

(57) ABSTRACT

The present invention provides an journal box rubber pad and a bogie, wherein the journal box rubber pad comprises a glue-injection hole and a conductive mechanism: the glue-injection hole comprises a cavity formed in a rubber layer, a first hole formed on an upper wear liner and a second hole formed on a lower wear liner. The cavity, the first hole and the second hole are communicated with each other; the conductive mechanism is placed internally in the glue-injection hole; the two ends of the conductive mechanism pass through the first hole and the second hole respectively and be in contact with two conducted apparatuses. The journal box rubber pad and the bogie of the present invention have the advantages that: the journal box rubber boxes not only can overcome the disadvantages that the upper and the lower wear liners are easy to be abraded and have poor contact with a bogie side frame and an adapter because of the requirements of high manufacturing accuracy but also can realize conductive function.

11 Claims, 3 Drawing Sheets

JOURNAL BOX RUBBER PAD AND BOGIE

FIELD OF THE TECHNOLOGY

The present invention relates to the technique of elements of a railway vehicle, and particularly to a journal box rubber pad and a bogie.

BACKGROUND

A railway wagon generally comprises a wagon body, a bogie and a braking device, wherein the most commonly used bogie on the railway wagon is a two-axle cast steel three-piece bogie. As shown in FIG. 1, FIG. 1 is a structure view of the bogie of the prior art. The bogie comprises a bolster 11, two bogie side frames 12 and two wheel sets 13, wherein the ends of the wheel sets 13 are provided with an adapter 14. The bogie side frame 12 can be connected with the wheel sets 13 via the adapter 14. In order to improve the dynamic performance of a vehicle, a journal box rubber pad 15 is mounted between the bogie side frame 12 and the adapter 14. The journal box rubber pad 15 has the advantages that the elastic positioning between the wheel sets 13 and the side frames 12 can be obtained; the impulsive load between wheels and rails and the vibration of the vehicle can be reduced, and the dynamic performance of the vehicle can be improved.

FIG. 2 is a structural view of Embodiment 1 of a journal box rubber pad of the prior art. Refer to FIG. 2, the journal box rubber pad mainly comprises an upper wear liner 16, a lower wear liner 17 and a rubber layer 18 which is vulcanized and formed therein, wherein the upper and the lower wear liners are generally metal boards. The journal box rubber pad is generally in plane shape or in the shape of Chinese character "八" when it is viewed from the side. Moreover, in order to adapt to railway electrification which is developed gradually currently, connection wires can be installed between the upper wear liner and the lower wear liner. Through the contact between the upper wear liner 16 and the bogie side frame as well as the contact between the lower wear liner 17 and the adapter, the journal box rubber pad can have conductive function, and the space between the bogie side frames and the wheel sets become a conductor. Therefore, the railway vehicles have conductive capacity by themselves, which prevents the potential difference among the vehicles, the ground and the rails from harming the vehicle operators standing on the ground. However, there are still certain problems of the journal box rubber pad installed with wires. That is, the upper and the lower wear liners are difficult to manufacture, which results in the following disadvantages that: the accuracy is low; the contacting states between the upper wear liner and the bogie side frames as well as that between the lower wear liner and the adapter are then poor; loads can not be spread effectively; the dynamic performance of the vehicles is getting worse; the upper and the lower wear liners made of metal are easy to produce abrasion; especially when the contact state is poor, the abrasion will become more serious.

FIG. 3 is the structural view of Embodiment 2 of a journal box rubber pad of the prior art. As shown in FIG. 3, in order to overcome the above defects of the journal box rubber pad and improve the dynamic performance of the vehicles, one thin rubber layer 19 can be vulcanized on the outer surfaces of the upper wear liner 16 and the lower wear liner 17, respectively. The overall shapes of the upper and the lower wear liners can be guaranteed by the thin rubber layer 19 and a vulcanization mould, which can decrease the manufacturing accuracy of the upper and the lower wear liners. In additions, as there is the thin rubber layer 19, the contact state between the journal box rubber pad and the bogie side frames as well as that between the journal box rubber pad and the adapters can be improved; the vertical distribution is even; bearings are stressed in equilibrium; the positioning between the journal box rubber pad and the side frames as well as that between the journal box rubber pad and the adapters become more sufficient, and there is not any abrasion between the upper and the lower wear liners.

However, the disadvantages of the journal box rubber pad of the structure shown in FIG. 3 are also obvious. That is, as there is the thin rubber layer 19, the electric conduction of the journal box rubber pad can not be realized according to connecting the upper board with the lower wear liners by wires; therefore, there may be potential difference between the vehicle and the ground as well as that between the vehicle and the rails, which may cause potential safety hazard to the vehicle operators standing on the ground.

SUMMARY

One embodiment of the invention provides an journal box rubber pad and a bogie so that the conductive function of the journal box rubber pad still can be realized even when the journal box rubber pad has a thin vulcanization rubber layer between the surfaces of the upper and the lower wear liners.

One embodiment of the invention provides an journal box rubber pad, which comprises an upper wear liner, a lower wear liner, a rubber layer positioned between the upper wear liner and the lower wear liner and a thin rubber layer formed on the outer surfaces of the upper wear liner and the lower wear liner respectively. The journal box rubber pad also comprises a glue-injection hole and a conductive mechanism, wherein the glue-injection hole comprises a cavity formed in the rubber layer, a first hole formed on the upper board and a second hole formed on the lower wear liner; the cavity, the first hole and the second hole are communicated with each other. The conductive mechanism is internally positioned in the glue-injection hole; the two ends of the conductive mechanism pass through the first hole and the second hole respectively and contact with two conducted apparatuses.

One embodiment of the invention provides a bogie, which comprises a bolster, bogie side frames, and wheel sets, wherein the bogie side frames are connected with the wheel sets via an adapter being positioned at the ends of the wheel sets; an journal box rubber pad used to produce an elastic buffer effect is provided between the bogie side frames and the adapter, and the abovementioned journal box rubber pad is adopted for the journal box rubber pad.

As for the journal box rubber pad and the bogie in the embodiments of the invention, the conductive mechanism is internally placed in the glue-injection hole of the journal box rubber pad, and the two end surfaces of the conductive mechanism contact the bogie side frames and the adapters respectively, which solves the problems of the journal box rubber pad in the prior art that the wear liner provided with the thin rubber layer can not have conductive function at the same time; therefore, the journal box rubber pad not only can overcome the disadvantages of high manufacturing accuracy required by the upper and the lower wear liners, easy abrasion, easy poor contact between the wear liner and the side frame as well as that between the wear liner and the adapter but also can realize conductive function.

BRIEF DESCRIPTION OF THE DRAWINGS

In order to explain the embodiments of the invention and the technical solution of the prior art more clearly, the drawings needed by the embodiments or the description of the prior art are introduced simply in following details. It is obvious that the drawings described in the following are a plurality of embodiments of the invention. As for those persons skilled in this art, they can achieve other drawings according to these drawings under the premise that they do not provide creative labor.

Figure 1:
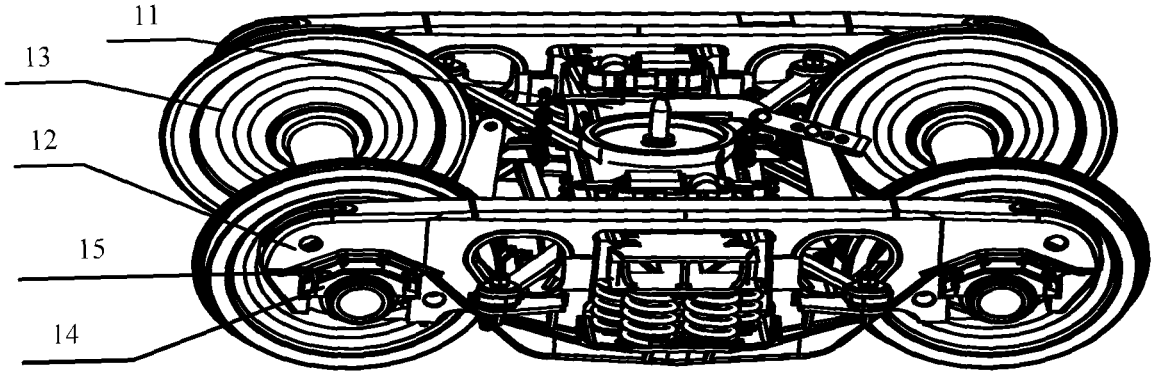
FIG. 1 is a structural view of a bogie of the prior art.
Figure 2:
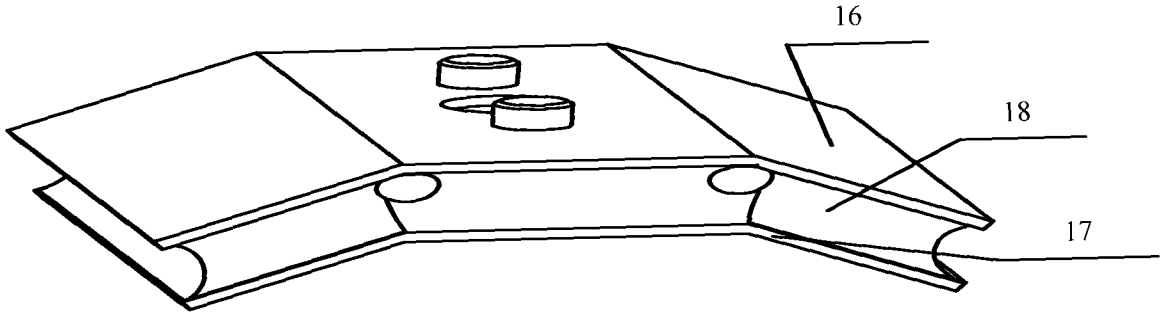
FIG. 2 is a structural view of Embodiment 1 of an journal box rubber pad of the prior art.
Figure 3:
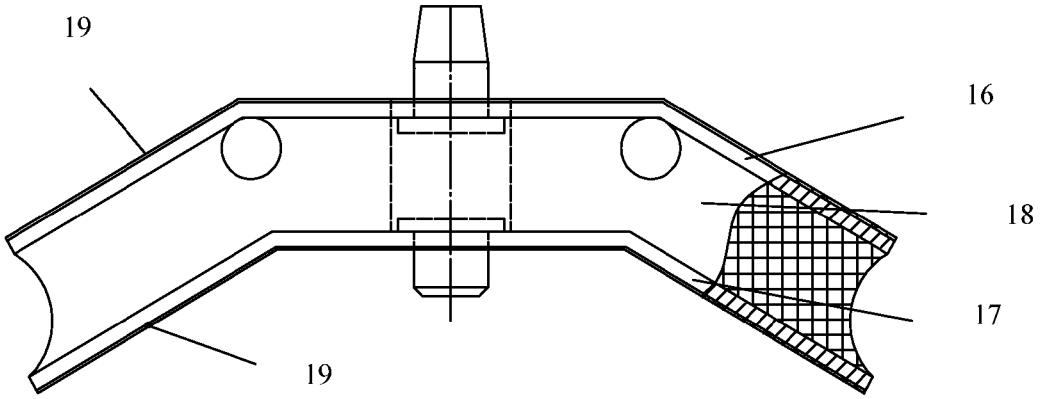
FIG. 3 is a structural view of Embodiment 2 of an journal box rubber pad of the prior art.

Reference signs mentioned in the drawings:

| | | |
|---|---|---|
| 11 Bolster | 12 Bogie side frame | 13 Wheel set |
| 14 Adapter | 15 Journal box rubber pad | 16 Upper wear liner |
| 17 Lower wear liner | 18 Rubber layer | 19 Thin rubber layer |
| 20 Glue-injection hole | 21 First conductive pin | 22 Second conductive pin |
| 23 Wires | 24 Spring | 25 Rivet |
| 26 Sealing apparatus | 27 Block pad | 28 Positioning pin |

DETAILED DESCRIPTION

In order to make the objects, technical solutions and merits of the present invention clearer, a further detailed description of embodiments of the present invention is given by reference to accompanying drawings. It is obvious that the described embodiments is one part of the embodiments of the invention and is not the whole embodiments. Base on the embodiments of the invention, those persons skilled in the art can obtain all other embodiments not under the premise that they should provide creative labor. These embodiments all are within the protection range of the invention.

The main technical solution of the present invention is as follows: a conductive mechanism is internally placed in a glue-injection hole of an journal box rubber pad; two end surfaces of the conductive mechanism are respectively higher than the surfaces of an upper wear liner and a lower wear liner; the conductive function can be realized according to the two end surfaces of the conductive mechanism being in contact with the bogie side frames and the adapters respectively.

With the following drawings and embodiments, the technical solution of the present invention can be further described in details.

Embodiment 1

Figure 4:
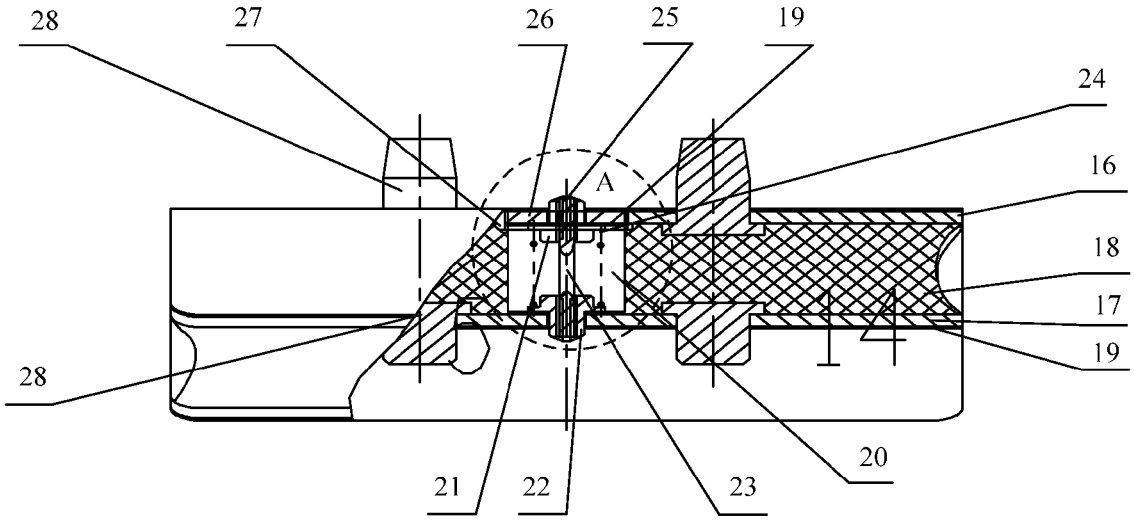
FIG. 4 is the structural view of one embodiment of an journal box rubber pad of the invention.
Figure 5:
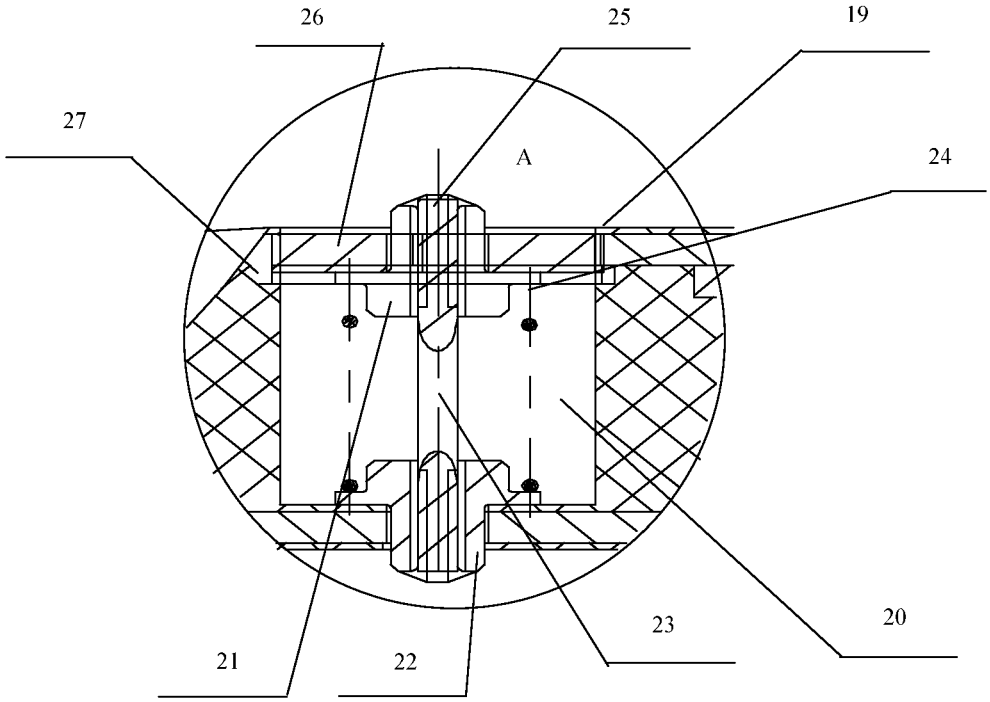
FIG. 5 is a partial enlargement drawing of Zone A in the FIG. 4.

FIG. 4 is a structural view of one embodiment of an journal box rubber pad of the invention. FIG. 5 is a partial enlargement drawing of Zone A in FIG. 4. With the combination of FIG. 4 and FIG. 5, the journal box rubber pad of the embodiment can be used for a bogie of a railway wagon and can comprise an upper wear liner 16, a lower wear liner 17, a rubber layer 18 vulcanized and formed between the upper wear liner and the lower wear liner, a thin rubber layer 19 formed on the surfaces of the upper and the lower wear liners respectively, a glue-injection hole and a conductive mechanism placed in the glue-injection hole 20.

Specifically, the glue-injection hole 20 can be provided at the middle part of the journal box rubber pad. The glue-injection hole 20 can comprise a cavity formed in a rubber layer 18, a first hole positioned on the upper wear liner and a second hole positioned on the lower wear liner, wherein the first hole and the second hold both communicated with the cavity. The conductive mechanism is placed in the glue-injection hole 20. Two ends of the conductive mechanism pass through the first hole and the second hole respectively and contact with two conducted apparatuses; therefore, the electric conduction between the two apparatuses can be realized. When the journal box rubber pad is used for the bogie of the railway wagons, the two ends of the conductive mechanism can contact with the bogie side frames and the adapters respectively. A gap is reserved between the conductive mechanism and the glue-injection hole. Therefore, when the bogie is operating on wires, the journal box rubber pad can be adapted to the contraction and shearing force caused by the vibration of a vehicle, and the journal box rubber pad can bear vertical, lateral and longitudinal displacements without damage.

Firstly, the structure of the conductive mechanism can be explained as follows: in the embodiment, the conductive mechanism can comprise a first conductive pin 21, a second conductive pin 22, wires 23 and a spring 24, wherein the head part of the first conductive pin 21 can pass through a first hole on the upper wear liner; the end surface of the head part extends out of and is higher than the surfaces of a thin rubber layer and can be used for contacting a bogie side frame. The head part of the second conductive pin 22 can pass a second hole on the lower wear liner; the end surface of the head part extends out of the thin rubber layer surfaces on the lower wear liner and can be used for contacting an adapter.

Wires 23 connect the first conductive pin 21 and the second conductive pin 22. Copper stranded wires can be adopted for the wires 23. The bases of the first conductive pin 21 and the second conductive pin 22 can be connected through the copper stranded wires, wherein the first conductive pin 21 and/or the second conductive pin 22 can be connected with the wires 23 through a rivet 25. Fox example, the connection can be realized through a blind rivet; or the conductive pins can be connected with the wires 23 through a pin hole, for example, the diameters of the holes at the middle parts of the first conductive pin 21 and the second conductive pin 22 are provided and slightly larger than the diameters of the wires 23. When being installed, the wires 23 is penetrated into the hole of the conductive pin, and then the wires 23 is clamped by the tail part of the conductive pin being pressed into a flat shape, hence the first conductive pin 21 and the second conductive pin 22 can connect reliably.

A spring 24 can be sleeved on the wires 23 and provide a support between the first conductive pin 21 and the second conductive pin 22. The spring 24 can be a cylinder-shaped helical spring, of which the two ends can be connected with the bases of the first conductive pin 21 and the second conductive pin 22 respectively. When the journal box rubber spring is mounted on a bogie, with the elastic support provided by the spring 24, the conductive pin can contact the bogie side frame and the adapter reliably under various conditions, so as to maintain a conductive passage from the bogie side frame to the adapter.

Secondly, the connecting structure of the conductive mechanism and the glue-injection hole can be explained as follows: the diameter of the second hole on the lower wear liner 17 can be slightly larger than that of the head part of the second conductive pin 22 and be smaller than the diameter of the base of the second conductive pin 22 and that of the cavity. The head part of the second conductive pin 22 passes through the second hole.

The diameter of the first hole on the upper wear liner 16 is slightly larger than that of the base of the first conductive pin 21 and that of the cavity. The first conductive pin 21 is directly put into the first hole. Meanwhile, a sealing apparatus 26 can be provided. It is sealed connection between the sealing apparatus 26 and the first hole, i.e., the first hole is sealed by the sealing apparatus 26, so as to realize that the whole conductive mechanism is sealed and blocked in the glue-injection hole.

Specifically, a third hole can be provided on the sealing apparatus 26. The diameter of the third hole is larger than that of the head part of the first conductive pin 21 and smaller than that of the base of the first conductive pin 21. For example, the diameter of the third hole can be provided to be the same as the diameter of the second hole on the lower wear liner. The head part of the first conductive pin 21 passes through the third hole and the base of the first conductive pin 21 is pressed with a lower end surface of the sealing apparatus, so as to sealing the conductive mechanism in the glue-injection hole.

The sealing apparatus 26 can be in threaded connection with the first hole. Meanwhile, the sealing apparatus is a plug. For example, an outer thread is provided at the outer surfaces of the sealing apparatus and its diameter is slightly larger than that of the cavity in the rubber layer. The first hole is a thread hole (i.e., inner thread). The diameter of the threaded hole is slightly larger than that of the base of the first conductive pin 21. The sealing apparatus 26 can be screwed into the first hole and press the first conductive pin 21. When the sealing apparatus 26 is screwed into a certain depth, it is blocked by the rubber layer and stop fastening. Or, the sealing apparatus 26 also can be connected with the first hole according to interference fit connection. That is, threads are not provided at the outer surface of the sealing apparatus 26 and the inner surface of the first hole on the upper wear liner 16. However, the outer diameter of the sealing apparatus 26 should slightly larger than the inner diameter of the first hole. During assembly, the sealing apparatus 26 can be pressed, assembled and compacted by pressure and is kept not to be released.

Furthermore, a block pad 27 is fastened on the upper wear liner 16. The block pad 27 can be welded on the upper wear liner 16 and be positioned between the lower end surface of the sealing apparatus 26 and the base of the first conductive pin 21. The block pad 27 is provided to avoid the problem of the unreliable connection between the sealing apparatus 26 and the upper wear liner when the upper wear liner 16 is relatively thin, to increase the effective thickness of the upper wear liner and further strengthen the connection of the sealing apparatus. For example, after the block pad 27 is provided, the sealing apparatus 26 can be in threaded connection with the first hole and the block pad; therefore, the connection between the upper wear liner 16 and the sealing apparatus 26 becomes more reliable.

The manufacturing and using processes of an journal box rubber pad of the embodiment of the invention is further explained in the following details, wherein copper stranded wires are adopted as the wires, for example:

Firstly, the conductive mechanism can be assembled. When assembling, establish a connection between the second conductive pin 22 and the copper stranded wires first of all, wherein the connection can be obtained with the adopt of blind rivets. Then, a spring used for supporting is sleeved onto the copper stranded wires. As the diameter of the base of the second conductive pin 22 is larger than the inner diameter of the spring 24, the spring 24 can be blocked in the base of the second conductive pin 22 and can not be released. The first conductive pin 21 is connected with the copper stranded wires through the compression spring 24 by blink rivets. Therefore, a conductive mechanism consists of the first conductive pin 21, the second conductive pin 22, the copper stranded wires and the spring 24.

Secondly, the glue-injection hole is provided and filled with the glue which is then vulcanized. Before the journal box rubber is vulcanized, one round hole (that is, the second hole) is provided at the middle part of the lower wear liner 17 beforehand. The diameter of the second hole is slightly larger than the diameter of the head part of the second conductive pin 22 and is smaller than the diameter of the base thereof. One first hole (for example, a threaded hole) is provided at the middle part of the upper wear liner 16. The diameter of the threaded hole is slightly larger than the diameter of the base of the first conductive pin 21. During the vulcanization of the journal box rubber pad, the threaded hole at the middle part of the upper wear liner 16 is taken as the glue-injection hole. When the glue is injected, a pressure pin of which the diameter is slightly larger than the diameter of the base of the first conductive pin 21 and is slightly smaller than the diameter of the threaded hole is adopted for the pressing and injecting of the glue. After the glue is injected, the pressure pin in the threaded hole of the upper wear liner is pressed into the lower wear liner 17 directly, and then the glue is pressurized and vulcanized. After the vulcanization is completed, a cylinder-shaped cavity structure of which the diameter is slightly larger than that of the first conductive pin 21 and that of the base of the second conductive pin 22 and is slightly smaller than that of a threaded hole of the upper wear liner 16 is formed at the middle of the rubber layer. The threaded hole is provided on the upper wear liner 16 at the corresponding part. The round hole is provided on the lower wear liner.

Then, the conductive mechanism is mounted into the glue-injection hole. The mounted conductive mechanism is penetrated into the threaded hole of the upper wear liner 16, which facilitates the head part of the second conductive pin 22 to pass through the round hole (that is, the second hole) of the lower wear liner 16. A sealing apparatus (for example, a plug) with a hole (that is, the third hole. The diameter of the hole can be the same as that of the second hole in the middle of the lower wear liner 17) provided in the middle thereof is screwed into the threaded hole at the middle of the upper wear liner 16 and presses the first conductive pin 21. At this time, the rubber layer 18 is compressed. When the plug is screwed into a certain depth, as the diameter of the cavity is slightly smaller than the diameter of the outer thread, the plug is blocked by the rubber layer 18 and stops. In addition, during the assembly, through proper design, the end surface of the second conductive pin 22 is slightly higher than the outer surface of the vulcanized thin rubber layer of the lower layer of the lower wear liner 17, which facilitates the end surface of the first conductive pin 21 is slightly higher than the outer surface of the vulcanized thin rubber layer of the lower surface of the lower wear liner 17.

Furthermore, being taken as a positioning piece between the journal box rubber pad and the bogie side frame as well as between the journal box rubber pad and an adapter, a positioning pin 28 can be provided or can not be provided according to the requirements of a concrete structure. In additions, as the effective thickness of he block pad 27 welded on the upper wear liner 16 is increased, the connection between the upper wear liner 16 and the plug becomes more reliable.

When being used, the journal box rubber pad of the embodiment is assembled between the bogie side frame and the adapter. The end surface of the head part of the first conductive pin of the journal box rubber pad is in contact with the bogie side frame, and the end surface of the head part of the second conductive pin is in contact with the adapter. In FIG. 5, as the end surface of the head part of the first conductive pin 21 is higher than the thin rubber layer of the upper surface of the upper wear liner and the end surface of the head part of the second conductive pin 22 is higher than the thin rubber layer of the lower surface of the lower wear liner, the two conductive pin is pressed by the bogie side frame and the adapter. As the internal spring 24 between the two conductive pins support outwards, the spring 24 is compressed. Then, the two conductive pins are recessed into the journal box rubber pad until the end surface of the head part of the conductive pin is maintained even with the surfaces of the upper and the lower wear liners. As the spring 24 is compressed, the produced counter force acts on the two conductive pins, and presses them against the bogie side frame and the adapter, so that the reliable contact between the conductive pin and the side frame as well as that between the conductive pin and the adapter can be maintained. Regardless of static state and running state of vehicles, the deformations of the journal box rubber pad generated by the vertical compression and the transverse and longitudinal shearing forces are all so. Therefore, the conductive function of the connection between the side frame and the adapter is realized.

As for the journal box rubber pad of the embodiment, through the conductive mechanism internally placed in the glue-injection hole of the journal box rubber pad, the two end surfaces of the conductive mechanism respectively contact the bogie side frame and the adapter is utilized, which solves the problems that the conductive functions of the journal box rubber pad of the prior art provided with the thin rubber layer can not be realized at the same time. The journal box rubber pad not only can overcome the disadvantages of high manufacturing accuracy of the upper and the lower wear liners, easy abrasion and easy poor contact between the journal box rubber pad and the bogie side frame as well as that between the journal box rubber pad and the adapter but also can realize the conductive function.

Embodiment 2

The embodiment provides a bogie, comprising a bolster, a bogie side frame and wheel sets, wherein the bogie side frame is connected with the wheel sets through the adapter provided at the ends of the wheel sets; the journal box rubber pad with elastic buffer action is provided between the bogie side frame and the adapter.

The main differences between the bogies of the embodiments and the prior art are as follows: the journal box rubber pad of the embodiment 1 can be adopted. Through the adoption of the journal box rubber pad, the thin rubber layer can be provided on the surfaces of the wear liners while the conductance between the side frame and the adapter can be realized; therefore, the journal box rubber pad not only can overcome the disadvantages of high manufacturing accuracy of the upper and the lower wear liners, easy abrasion and easy poor contact between the journal box rubber pad and the bogie side frame as well as that between the journal box rubber pad and the adapter but also can realize the conductive function.

Finally, it should be understood that: the above embodiments are only used to explain but not to limit the technical solution of the present invention. In despite of the detailed description of the present invention with referring to above preferred embodiments, it should be understood that various modifications, changes or equivalent replacements can be made by those skilled in the art without departing from the scope of the present invention and covered in the claims of the present invention.

What is claimed is:

1. A journal box rubber pad, comprising an upper wear liner, a lower wear liner, a rubber layer positioned between the upper wear liner and the lower wear liner and a thin layer rubber formed on the outer surfaces of the upper and lower wear liners respectively, characterized in that the rubber pad also comprises:

a glue-injection hole comprising a cavity formed in the rubber layer, a first hole formed on the upper wear liner and a second hole formed on the lower wear liner; the cavity, the first hole and the second hole being communicated with each other; and a conductive mechanism placed in the glue-injection hole; the two ends of the conductive mechanism passing through the first hole and the second hole respectively and being in contact with two conducted apparatuses;

wherein the conductive mechanism comprises:

a first conductive pin with its head part passing through the first hole and the end surface of the head part extending out of the thin-layer rubber surface on the upper wear liner;

a second conductive pin with its head part passing through the second hole and the end surface of the head part extending out of the thin-layer rubber surface on the lower wear liner;

wires connected to the first conductive pin and the second conductive pin to realize the electric conduction between the first conductive pin and the second conductive pin; and a spring sleeved onto the wires, wherein the two ends of the spring contact with a base of the first conductive pin and a base of the second conductive pin to support elastically the first conductive pin and the second conductive pin.

2. The journal box rubber pad of claim 1, characterized in that the first conductive pin and/or the second conductive pin are/is connected with the wires through a rivet.

3. The journal box rubber pad of claim 1, characterized in that the first conductive pin and/or the second conductive pin are/is connected with the wires through a pin hole.

4. The journal box rubber pad of claim 1, characterized in that the diameter of the second hole is larger than the diameter of the head part of the second conductive pin and is smaller than the diameter of the base of the second conductive pin, the diameter of the cavity is larger than the diameter of the second hole, the diameter of the first hole is larger than the diameter of the base of the first conductive pin and the diameter of the cavity; and a sealing apparatus is sealing connected with the first hole to seal the conductive mechanism in the glue-injection hole, a third hole is arranged on the sealing apparatus, the diameter of the third hole is larger than the diameter of the head part of the first conductive pin and is smaller than the diameter of the base of the first conductive pin, the head part of the first conductive pin passes through the third hole, and the base of the first conductive pin is pressed with the sealing apparatus.

5. The journal box rubber pad of claim 4, characterized in that the sealing apparatus and the first hole are in threaded connection.

6. The journal box rubber pad of claims 5, characterized in that it also comprises:

a block pad arranged between the end surface of the sealing apparatus and the base of the first conductive pin, and fixed on and connected with the upper wear liner;

wherein the sealing apparatus and the block pad are sealing connected with each other.

7. The journal box rubber pad of claim 4, characterized in that the sealing apparatus and the first hole are in interference connection.

8. The journal box rubber pad of claims 7, characterized in that, also comprises:

a block pad arranged between the end surface of the sealing apparatus and the base of the first conductive pin, and fixed on and connected with the upper wear liner; wherein the sealing apparatus and the block pad are sealing connected with each other.

9. The journal box rubber pad of claims 4, characterized in that it also comprises:

a block pad arranged between the end surface of the sealing apparatus and the base of the first conductive pin, and fixed on and connected with the upper wear liner; wherein the sealing apparatus and the block pad are sealing connected with each other.

10. The journal box rubber pad of claim 1, characterized in that a gap is provided between the conductive mechanism and the glue-injection hole.

11. A bogie, comprising a bolster, a bogie side frame and a wheel set, wherein the bogie side frame is connected with the wheel set through an adapter arranged on the ends of the wheel set; an journal box rubber pad which can be used for elastic buffer is provided between the bogie side frame and the adapter, characterized in that any one of the journal box rubber pads according to claim 1 is adopted for the journal box rubber pad.

* * * * *